US009232822B1

(12) United States Patent
Khubani

(10) Patent No.: US 9,232,822 B1
(45) Date of Patent: Jan. 12, 2016

(54) WOMEN'S GARMENT

(71) Applicant: Poonam Khubani, Saddle River, NJ (US)

(72) Inventor: Poonam Khubani, Saddle River, NJ (US)

(73) Assignee: International Edge, Inc., Fairfield, NJ (US)

( * ) Notice: Subject to any disclaimer, the term of this patent is extended or adjusted under 35 U.S.C. 154(b) by 0 days.

(21) Appl. No.: 14/302,325

(22) Filed: Jun. 11, 2014

Related U.S. Application Data

(60) Provisional application No. 61/833,789, filed on Jun. 11, 2013.

(51) Int. Cl.
*A41C 1/00* (2006.01)

(52) U.S. Cl.
CPC ..... *A41C 1/00* (2013.01)

(58) Field of Classification Search
CPC ..... A41C 1/00; A41C 1/02; A41C 1/06; A41C 1/08; A41C 1/12; A41C 1/14; A41C 1/16; A41C 1/006
USPC ..... 450/86, 3, 5, 6, 54–57, 38, 41, 45; 2/106, 122, 255, 256, 258–261, 273
See application file for complete search history.

(56) References Cited

U.S. PATENT DOCUMENTS

| | | | | | |
|---|---|---|---|---|---|
| 1,516,249 | A * | 11/1924 | Rothstein | 450/3 |
| 3,314,432 | A * | 4/1967 | Erteszek | 450/31 |
| 4,187,855 | A * | 2/1980 | Paulus et al. | 450/3 |
| 5,180,326 | A * | 1/1993 | Williams | 450/91 |
| D503,509 | S | 4/2005 | Bell et al. | |
| 6,883,179 | B1 * | 4/2005 | Crum | 2/105 |
| D600,881 | S | 9/2009 | Naylor | |
| D623,377 | S | 9/2010 | Schindler | |
| 8,827,940 | B2 * | 9/2014 | Anquetil | 602/19 |
| 2006/0218699 | A1 * | 10/2006 | Chetelat et al. | 2/256 |
| 2011/0277202 | A1 * | 11/2011 | McQueer | 2/2.5 |

* cited by examiner

*Primary Examiner* — Gloria Hale
(74) *Attorney, Agent, or Firm* — Cooper & Dunham LLP

(57) ABSTRACT

A garment is disclosed, which includes a bodice having a front portion with a neckline, a back portion, and a bottom, a padded lining disposed in the bodice and adjacent to the neckline, a plurality of adjustable straps attached to the front and back portions, a band lining the bottom of the bodice, and a non-visible boning disposed in the front portion configured to support and shape the abdomen of a user.

9 Claims, 2 Drawing Sheets

WOMEN'S GARMENT

BENEFIT OF PRIORITY

The present invention claims the benefit of priority to U.S. Provisional Application No. 61/833,789, filed Jun. 11, 2013.

TECHNICAL FIELD

The present invention relates generally to articles of clothing. More specifically, the present invention relates to garments having a slimming effect on an individual's body.

BACKGROUND OF THE INVENTION

Generally, garments provide a variety of aesthetic and functional features for individuals. Certain garments include functional features that are designed to aid in enhancing an individual's appearance. For example, compressive undergarments are designed to provide a smooth and/or slimming effect on portions of an individual's body.

However, problems exist with compressive undergarments, particularly with women's compressive garments designed to provide a slimming effect on the torso. For example, some garments are designed such that they slim the torso, at the expense of compressing the woman's breasts. Additionally, some garments are designed such that the bottom of the compressive garments accentuate the woman's body in an unflattering manner.

There is, therefore, a need for a women's garment that has a slimming effect on a woman's torso, while providing support and lift for the woman's breasts, and also providing support and shape for the woman's waist and hips.

SUMMARY OF THE INVENTION

It is an object of the present invention to provide a garment. The garment may include a bodice having a front portion with a neckline, a back portion, and a bottom, a padded lining disposed in the bodice and adjacent to the neckline, a plurality of adjustable straps attached to the front and back portions, a band lining the bottom of the bodice, and a non-visible boning disposed in the front portion configured to support and shape the abdomen of a user.

Implementations of the invention may include one or more of the following features. The padded lining may include side enhancements. The neckline of the front portion may be U-shaped. The non-visible boning may be sewn into the front portion. The non-visible boning may be connected to the band. Each of the adjustable straps may include a plurality of slots and a hook configured to engage with and attach to the plurality of slots. The bodice may include a material configured to create a slimming effect on the torso of the user. The material may be a woven lightweight microfiber. The material may be a LYCRA® spandex. The non-visible boning may be configured to be disposed above the thighs of a user.

BRIEF DESCRIPTION OF THE DRAWINGS

The above-mentioned and other aspects, features and advantages can be more readily understood from the following detailed description with reference to the accompanying drawings, wherein.

DETAILED DESCRIPTION OF THE PREFERRED EMBODIMENTS

The present invention provides for women's garments having slimming effects on the body. More specifically, the present invention provides for women's garments having the effects of reducing a women's waist and hip measurements, creating the appearance of an elongated torso, and supporting and lifting the women's breasts. It should be noted that the present invention should not be limited to use with women. The present invention may be used by any individual desiring to achieve a slimmer appearance.

Figure 1:
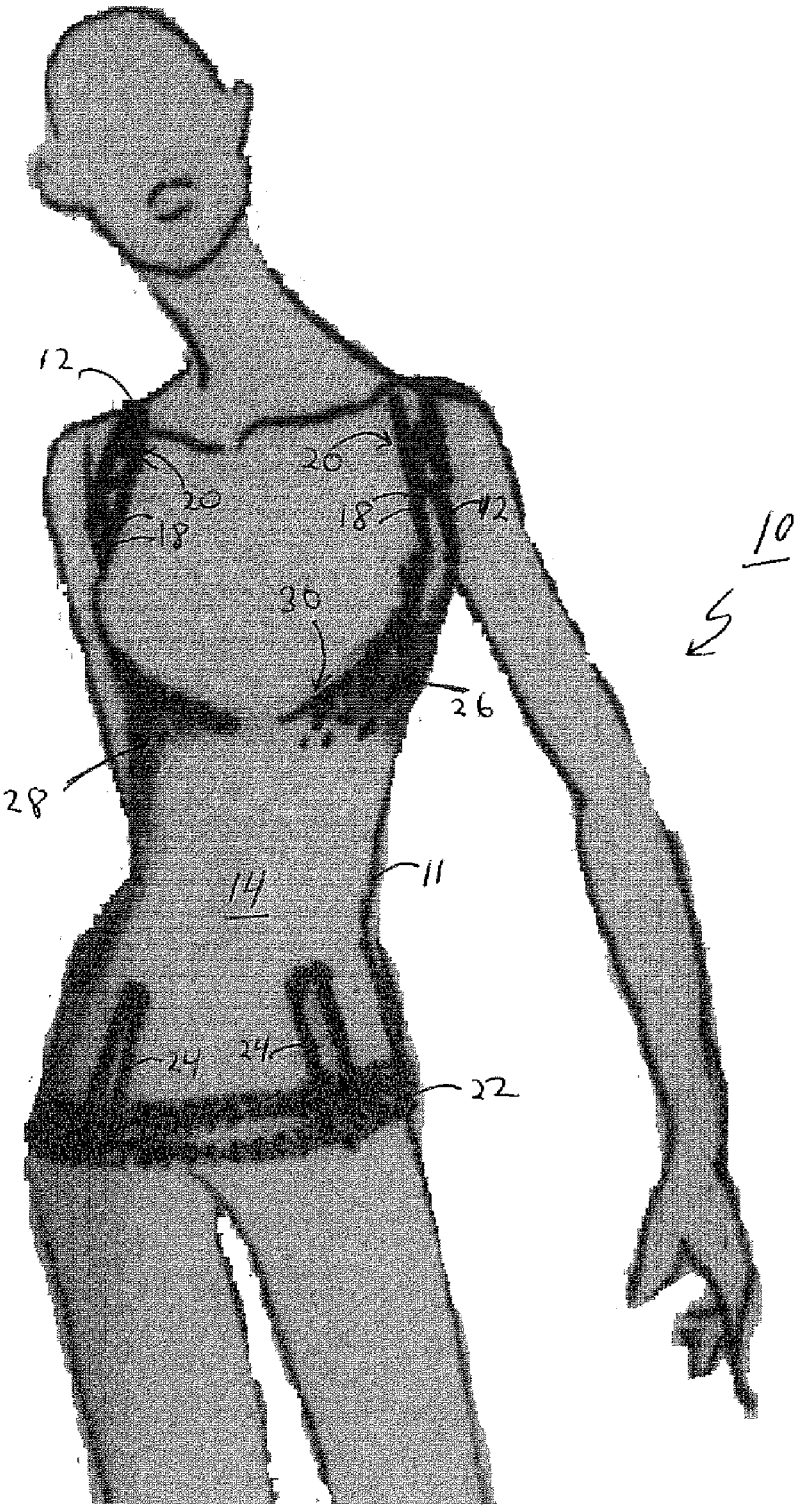
FIG. 1 is a front view of a women's garment, according to an embodiment of the present invention.
Figure 2:
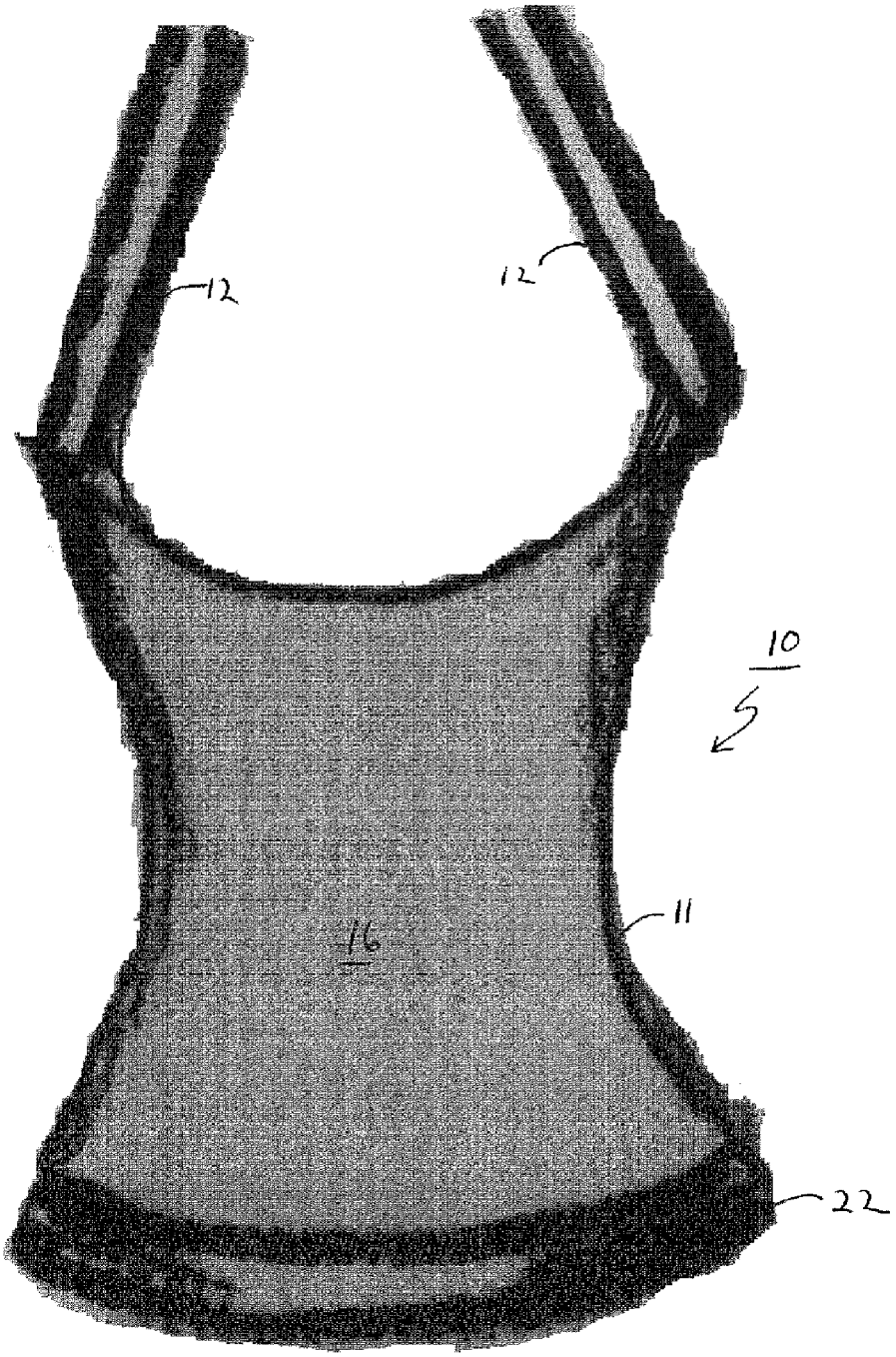
FIG. 2 is a back view of the women's garment of FIG. 1.

FIG. 1 illustrates a front view of a women's garment 10, according to an embodiment of the present invention, and FIG. 2 illustrates a back view of the woman's garment, according to an embodiment of the invention. The garment 10 may be configured to be worn by a woman as an undergarment or as outerwear in combination with another garment. FIG. 1 illustrates that the garment 10 is a single article of clothing. In alternative embodiments, the garment 10 may include multiple pieces configured to attach to one another.

As illustrated in FIG. 1, the garment 10 may include a bodice 11. The bodice 11 may have front 14 and back 16 portions and may be configured to surround a woman's torso. The bodice 11 may further be configured to have a slimming effect on the woman's torso. The slimming effect may be achieved by the size, shape, and/or configuration of the bodice 11. In addition, or alternatively, the slimming effect may be achieved by the material from which the bodice 11 may be constructed. For example, the bodice 11 may be constructed from any compressive fabric material known to those skilled in the art and configured to be thin and lightweight, but sufficiently elastic to create a desired slimming effect on the women's torso without adding bulk to the garment 10. In one embodiment, for example, the bodice 11 may be constructed from a woven, lightweight microfiber or LYCRA® spandex.

FIG. 1 illustrates that the front portion 14 of the garment 10 may be designed to lift and support a woman's breasts without covering them. The lift and support may be aided by the neckline 30 of the front portion. FIG. 1 illustrates that the front portion 14 may include a neckline 30 sized, shaped, and configured to lift a woman's breasts without compression by the material of which the bodice is formed. The neckline 30 may be any size, shape, and/or configuration known to those skilled in the art, including, but not limited to v-shaped or straight across. Alternatively, as illustrated in FIG. 1, the neckline 30 may be U-shaped.

FIG. 1 further illustrates that the front portion 14 may include a padded or quilted lining 26 for lifting and supporting the woman's breasts. The padded or quilted lining 26 may be located near the top of the front portion 14 of the bodice 11. The padded or quilted lining 26 may be a single piece of material or multiple pieces of spaced apart material positioned on the front portion 14 of the bodice 11. In some embodiments, as illustrated in FIG. 1, the front portion 14 and/or padded or quilted lining 26 may further include side enhancements 28 for aiding in the lifting and supporting of the woman's breasts.

The garment 10 may include straps 12 configured to rest on the woman's shoulders and maintain the bodice 11 in a desired position on the woman's torso. The straps 12 may be removably or permanently attached to the front 14 and back 16 portions of the garment 10. The straps 12 may be made of any fabric material known to those skilled in the art, including, but not limited to a soft fabric material, such as cotton.

The straps 12 may be flexible such that a woman may be configured to comfortably move while wearing the garment 10. In some embodiments, the straps 12 may be formed of an elastic material. In alternatively embodiments, the straps 12 may not be elastic.

The straps 12 may further be configured to be adjusted according to a woman's size, shape, and/or configuration. For example, FIG. 1 illustrates that the straps 12 may include a plurality of slots 18. The slots 18 may be any size, shape, and/or configuration known to those skilled in the art including, but not limited to, oval or round cutouts in the strap material. As illustrated in FIG. 1, the slots 18 may be located on the portion of the strap attached to the front portion 14 of the bodice 11. In alternative embodiments, the slots 18 may be located on the portion of the strap attached to the back portion 16 of the bodice 11. FIG. 1 illustrates three slots 18. In alternative embodiments, there may be any desired number of slots 18 known to those skilled in the art.

The slots 18 may be configured to cooperate with a hook 20 (e.g., metal or plastic hook) located on a portion of the strap 12 attached to the back portion 16 of the bodice 11. In alternative embodiments, the hook 20 may be located on the portion of the strap attached to the front portion 14 of the bodice 11. The hook 20 and slots 18 are removably attachable to each other by placing a slot 18 over the hook 20. The plurality of slots 18 allow for different degrees of lift of the woman's breasts by the front portion 14. This adjustment feature of the slots 18 and hook 20 allows the garment 10 to be adaptable to different body types.

FIGS. 1 and 2 illustrate that the bodice 11 may be lined with a wide band 22 that may be configured to prevent rolling up of the material that forms the front 14 and back 16 portions of the garment 10. The wide band 22 any size, shape, and/or configuration such that it may be configured to rest comfortably on the woman's skin at the lower hips, to maintain the position of the garment 10 on the woman, and to cause substantially no compression on the woman.

As illustrated in FIG. 1, the front portion 14 may further include a non-visible or invisible boning 24. The non-visible boning 24 may be positioned on each side of the front portion 14 and may be disposed above the woman's thighs. In some embodiments, as illustrated in FIG. 1, the boning 24 may be attached to the wide band 22. The boning 24 may be made of any material known to those skilled in the art, including, but not limited to, plastic, metal, and/or a stiff polyester. The boning 24 may be located within and/or behind the material making up the front portion 14 of the bodice 11. For example, as illustrated in FIG. 1, the boning 24 may be sewn directly into the front portion 14 of the bodice 11. The boning 24 may be configured to assist in the support and shaping of the woman's abdomen, including, but not limited to, hiding imperfections and protuberances in the area. The boning 24 may also be configured to assist the woman in maintaining correct posture, since a slight pressure in the lower abdomen would gently force a straighter standing and sitting position.

The embodiments and examples above are illustrative, and many variations can be introduced to them without departing from the spirit of the disclosure or from the scope of the appended clams. For example, elements and/or features of different illustrative and exemplary embodiments herein may be combined with each other and/or substituted with each other within the scope of this disclosure. The objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

What is claimed:

1. A garment, comprising:

a bodice having a front portion with a neckline, a back portion, and a bottom;

a padded lining disposed in the bodice and adjacent to the neckline;

a plurality of adjustable straps attached to the front and back portions;

a band lining the bottom of the bodice; and boning disposed in the front portion configured to support and shape the abdomen of a user;

wherein the bodice consists of a compression fabric material.

2. The garment of claim 1, wherein the padded lining includes side enhancements positioned in the bodice for aiding in the lifting and supporting of a woman's breasts.

3. The garment of claim 1, wherein the neckline of the front portion is U-shaped.

4. The garment of claim 1, wherein the boning is sewn into the front portion.

5. The garment of claim 1, wherein the boning is connected to the band.

6. The garment of claim 1, wherein each of the adjustable straps includes a plurality of slots and a hook configured to engage with and attach to the plurality of slots.

7. The garment of claim 1, wherein the compression fabric material is a woven microfiber.

8. The garment of claim 1, wherein the compression fabric material is spandex.

9. The garment of claim 1, wherein the boning is positioned in the garment such that when a user wears the garment, the boning is configured to be disposed above the thighs of a user.

* * * * *